US008739926B1

(12) United States Patent
Mori

(10) Patent No.: US 8,739,926 B1
(45) Date of Patent: Jun. 3, 2014

(54) SOUND-TRANSMITTING MEMBRANE AND ELECTRONIC DEVICE EQUIPPED WITH SOUND-TRANSMITTING MEMBRANE

(71) Applicant: Nitto Denko Corporation, Ibaraki (JP)

(72) Inventor: Masaaki Mori, Osaka (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 13/868,607

(22) Filed: Apr. 23, 2013

Related U.S. Application Data

(63) Continuation of application No. PCT/JP2012/008341, filed on Dec. 26, 2012.

(30) Foreign Application Priority Data

Nov. 21, 2012 (JP) ..... 2012-255236

(51) Int. Cl.
*E04B 1/84* (2006.01)
*E04B 1/82* (2006.01)
*E04B 1/74* (2006.01)

(52) U.S. Cl.
USPC ..... 181/291; 181/294; 181/286; 181/292

(58) Field of Classification Search
USPC ..... 181/291, 286, 290, 292, 293, 294
See application file for complete search history.

(56) References Cited

U.S. PATENT DOCUMENTS

| | | | | | |
|---|---|---|---|---|---|
| 4,071,040 | A * | 1/1978 | Moriarty | 137/199 |
| 4,949,386 | A * | 8/1990 | Hill | 381/349 |
| 4,987,597 | A * | 1/1991 | Haertl | 381/325 |
| 5,412,162 | A * | 5/1995 | Kindel | 181/150 |
| 5,828,012 | A * | 10/1998 | Repolle et al. | 181/175 |
| 6,512,834 | B1 * | 1/2003 | Banter et al. | 381/386 |
| 6,893,711 | B2 * | 5/2005 | Williamson et al. | 428/297.1 |
| 6,932,187 | B2 * | 8/2005 | Banter et al. | 181/149 |
| 2005/0220448 | A1 * | 10/2005 | Tei et al. | 396/25 |
| 2009/0320979 | A1 * | 12/2009 | Keleny et al. | 150/154 |
| 2010/0303270 | A1 * | 12/2010 | Parkins | 381/322 |
| 2013/0032285 | A1 * | 2/2013 | Mietta et al. | 156/250 |

FOREIGN PATENT DOCUMENTS

| | | | | |
|---|---|---|---|---|
| JP | 10-165787 | | 6/1998 | |
| JP | 10165787 | A * | 6/1998 | B01D 71/36 |
| JP | 2003-053872 | | 2/2003 | |
| JP | 2004-083811 | | 3/2004 | |

* cited by examiner

*Primary Examiner* — Edgardo San Martin
(74) *Attorney, Agent, or Firm* — Hamre, Schumann, Mueller & Larson, P.C.

(57) ABSTRACT

A sound-transmitting membrane (1) is provided that allows passage of sounds and prevents passage of foreign matters, the sound-transmitting membrane (1) including a supporting member (12) and a resin porous membrane (11) layered on the supporting member (12) and containing polytetrafluoroethylene as a main component. The supporting member (12) is a nonwoven fabric containing an elastomer. Since the supporting member (12) is a nonwoven fabric containing an elastomer, the insertion loss of the sound-transmitting membrane can be reduced for sounds of 3000 Hz.

4 Claims, 5 Drawing Sheets

SOUND-TRANSMITTING MEMBRANE AND ELECTRONIC DEVICE EQUIPPED WITH SOUND-TRANSMITTING MEMBRANE

This application is a Continuation of PCT/JP2012/008341 filed on Dec. 26, 2012, which claims foreign priority of Japanese Patent Application No. 2012-255236 filed on Nov. 21, 2012, the entire contents of both of which are incorporated herein by reference.

BACKGROUND OF THE INVENTION

1. Field of the Invention

The present invention relates to a sound-transmitting membrane, and an electronic device equipped with the sound-transmitting membrane.

2. Description of Related Art

In recent years, electronic devices, such as mobile phones, laptop computers, electronic notebooks, digital cameras, and video-game instruments, generally have a sound function. A sound emitter such as a speaker and a buzzer, or a sound receiver such as a microphone, is disposed inside a housing of an electronic device having a sound function. An opening is provided in the housing of the electronic device at a position corresponding to the sound emitter or the sound receiver. Sounds are transmitted via the opening. In addition, in order to prevent foreign matters such as waterdrops from entering into the housing of the electronic device, a sound-transmitting membrane that allows passage of sounds and prevents passage of foreign matters is disposed so as to cover the opening.

As a sound-transmitting membrane, a porous plastic membrane is known which is produced by forming pores in a polytetrafluoroethylene (hereinafter, occasionally referred to as "PTFE") film or an ultrahigh molecular polyethylene film (see JP 2003-53872 A).

JP 2003-53872 A proposes a sound-transmitting membrane in which a support is bonded to a porous plastic membrane, in view of ease of second processing of the sound-transmitting membrane, such as cutting, stamping, and bonding to a casing. Nets, nonwoven fabrics, and woven fabrics are mentioned as examples of the support. In addition, JP 2003-53872 A proposes a sound-transmitting membrane in which a support is bonded to a porous plastic membrane and of which the surface density is set within a predetermined range in order not to reduce the sound transmissibility of the sound-transmitting membrane.

JP 2004-83811 A proposes a water-proof sound-transmitting membrane that is a layered product composed of a plastic membrane and a support. Porous materials such as nets, foam rubbers, and sponge sheets, nonwoven fabrics, and woven fabrics, are mentioned as examples of the support.

In either JP 2003-53872 A or JP 2004-83811 A mentioned above, the acoustic characteristics of a sound-transmitting membrane using a nonwoven fabric as a support are not specifically discussed. In particular, the acoustic characteristics for a high-frequency range (for example, 3000 Hz) are not discussed at all.

SUMMARY OF THE INVENTION

The present invention aims to provide a sound-transmitting membrane that uses a nonwoven fabric as a support and exhibits good acoustic characteristics for a high-frequency range. The present invention also aims to provide an electronic device including such a sound-transmitting membrane.

The present invention provides a sound-transmitting membrane that allows passage of sounds and prevents passage of foreign matters, the sound-transmitting membrane including a supporting member, and a resin porous membrane layered on the supporting member and containing polytetrafluoroethylene as a main component. The supporting member is a nonwoven fabric containing an elastomer.

The present invention also provides an electronic device including: a sound emitter or a sound receiver; and the above sound-transmitting membrane disposed so as to cover an opening provided at a position corresponding to the sound emitter or the sound receiver.

The sound-transmitting membrane using as a support a nonwoven fabric containing an elastomer can reduce insertion loss for sounds of 3000 Hz, compared to sound-transmitting membranes using another type of nonwoven fabric as a support.

DETAILED DESCRIPTION OF THE INVENTION

Hereinafter, embodiments of the present invention will be described with reference to the drawings. The following description relates to some examples of the present invention, and the present invention is not limited by these examples.

Figure 1:
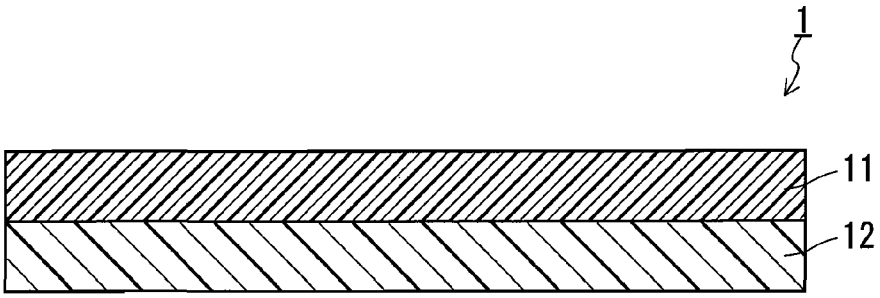
FIG. 1 is a cross-sectional view of an embodiment of a sound-transmitting membrane of the present invention.

As shown in FIG. 1, a sound-transmitting membrane 1 of the present embodiment includes a supporting member 12 and a resin porous membrane 11 containing PTFE as a main component. In the present description, the "main component" means a component whose content is the largest in terms of mass ratio. The resin porous membrane 11 is layered on the supporting member 12. The supporting member 12 is formed of a nonwoven fabric containing an elastomer. Since the resin porous membrane 11 has a porous structure, the sound-transmitting membrane 1 has the characteristic of preventing passage of foreign matters such as water and dust, and allowing transmission of gases. In addition, the sound-transmitting membrane 1 allows passage of sounds. Therefore, for example, in an electronic device equipped with a sound emitter or a sound receiver, the sound-transmitting membrane 1 is disposed to an opening provided in a housing and corresponding to the sound emitter or the sound receiver, and is suitably used to ensure the sound transmissibility, waterproof property, and dustproof property at the opening.

For example, the resin porous membrane 11 can be fabricated as follows: a kneaded product of PTFE fine powder and a forming auxiliary agent is formed into a sheet by extrusion molding and rolling; the forming auxiliary agent is removed from the formed body to obtain a sheet-shaped body; and then the sheet-shaped body is stretched. The resin porous membrane 11 thus fabricated has a porous structure in which innumerable spaces formed between fine fibers (fibrils) of PTFE act as pores. The average pore diameter and porosity of the porous structure of the resin porous membrane 11 can be adjusted by changing the conditions for stretching of the sheet.

From the standpoint of ensuring both the waterproof or dustproof property and the sound transmissibility, the average pore diameter of the resin porous membrane 11 is preferably 1 μm or less, more preferably 0.7 μm or less, and even more preferably 0.5 μm or less. The lower limit of the average pore diameter of the resin porous membrane 11 is not particularly limited, and is, for example, 0.1 μm. Here, the "average pore diameter" of the resin porous membrane 11 can be measured according to the standards specified in ASTM (American Society for Testing and Materials) F316-86, and can be measured using, for example, a commercially-available measurement apparatus (e.g., Perm-Porometer manufactured by Porous Materials, Inc.) that complies with the standards and is capable of automatic measurement.

From the standpoint of sound transmissibility, the surface density of the resin porous membrane 11 is preferably 2 to 10 $g/m^2$, more preferably 2 to 8 $g/m^2$, and even more preferably 2 to 5 $g/m^2$.

The resin porous membrane 11 may be subjected to coloring treatment. The main component of the resin porous membrane 11 is PTFE, and therefore, the intrinsic color of the resin porous membrane 11 is white. Accordingly, the resin porous membrane 11 is conspicuous when disposed to cover an opening of a housing. Therefore, if the resin porous membrane 11 is subjected to coloring treatment based on the color of the housing, it is possible to provide the resin porous membrane 11 that is less conspicuous when disposed in the housing. For example, the resin porous membrane 11 is colored black.

The resin porous membrane 11 may be subjected to liquid-repellent treatment. In this case, a porous membrane excellent in water-repellent performance or oil-repellent performance can be provided. Such a porous membrane is suitable for use in, for example, a sound-transmitting membrane that is required to have waterproof property. The liquid-repellent treatment can be performed by a commonly-known method. A liquid-repellent agent used for the liquid-repellent treatment is not particularly limited, and is typically a material containing a polymer having perfluoroalkyl groups.

It is sufficient that the supporting member 12 exhibits a flexibility to such an extent that the sound transmission mechanism triggered by vibration of the resin porous membrane 11 is not hindered. The elastomer of the supporting member 12 is desirably a thermoplastic elastomer. Examples of the thermoplastic elastomer include styrene-based thermoplastic elastomers (SBC), olefin-based thermoplastic elastomers (TPO), vinyl chloride-based thermoplastic elastomers (TPVC), urethane-based thermoplastic elastomers (TPU), ester-based thermoplastic elastomers (TPEE), and amide-based thermoplastic elastomers (TPAE). Specific examples include styrene-butadiene-styrene block copolymers (SBS), styrene-isoprene-styrene block copolymers (SIS), ethylene vinyl acetate elastomers (EVA), polyamide elastomers, and polyurethane elastomers. The supporting member 12 may be formed of a nonwoven fabric made of an elastomer. It is favorable that the elastomer of the supporting member 12 should contain at least one selected from an ethylene vinyl acetate elastomer, a polyurethane elastomer, and a polyamide elastomer.

For example, the supporting member 12 can be fabricated with the method described below. An elastomer material having been heated and molten is applied in a fibrous form onto a releasing film. The releasing film provides a flat surface for application of the elastomer material. The releasing film is not particularly limited, and it is favorable that a film made of a resin such as silicone and polyethylene terephthalate should be used. For example, an EVA resin is applied by being sprayed onto the releasing film at a high temperature (170° C. to 200° C.) with a high pressure (2 to 5 $kg/cm^2$). If an elastomer material is applied in this manner, a nonwoven fabric having a uniform thickness can easily be formed on the releasing film. The supporting member 12 can be obtained by separating the nonwoven fabric from the releasing film.

The supporting member 12 and the resin porous membrane 11 which have been obtained as described above are layered by, for example, hot press, and thus the sound-transmitting membrane 1 can be obtained. From the standpoint of the sound transmissibility, the surface density of the sound-transmitting membrane 1 is preferably 5 to 50 $g/m^2$, more preferably 5 to 30 $g/m^2$, and even more preferably 5 to 15 $g/m^2$.

As to the insertion loss, the sound-transmitting membrane 1 exhibits such acoustic characteristics that the insertion loss for sounds of 3000 Hz is smaller than or equal to 5 dB. Therefore, the sound-transmitting membrane 1 exhibits such good acoustic characteristics that the insertion loss is low in a relatively high frequency range, even though the sound-transmitting membrane 1 has a structure in which the resin porous membrane 11 is layered on the supporting member 12 including a nonwoven fabric. Here, the insertion loss means a difference in sound pressure level between the case where the sound-transmitting membrane 1 is present in a path through which sounds are transmitted and the case where the sound-transmitting membrane 1 is not present in a path through which sounds are transmitted. In addition, the sound-transmitting membrane 1 exhibits such acoustic characteristics that the ratio of the insertion loss for sounds of 3000 Hz to the insertion loss for sounds of 1000 Hz is 1.0 to 2.0. Thus, the sound-transmitting membrane 1 can exhibit similar levels of insertion loss for both sounds of 1000 Hz and sounds of 3000 Hz. In the sound-transmitting membrane 1, the ratio of the insertion loss for sounds of 3000 Hz to the insertion loss for sounds of 1000 Hz is preferably 1.0 to 1.5, and more preferably 1.0 to 1.2. Furthermore, the sound-transmitting membrane 1 exhibits such acoustic characteristics that the difference between a maximum value and a minimum value of the insertion losses for sounds of 100 Hz to 4000 Hz is smaller than or equal to 5 dB. Therefore, the sound-transmitting membrane 1 can exhibit such acoustic characteristics that the insertion loss does not vary much for sounds in a frequency range of 100 Hz to 4000 Hz.

Figure 2:
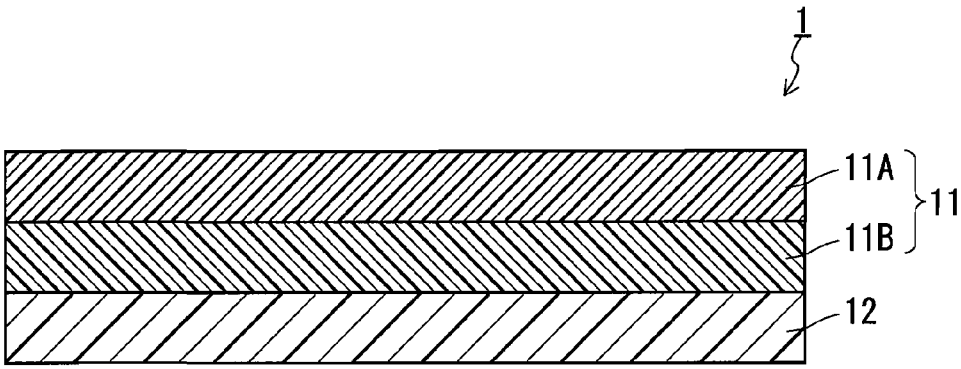
FIG. 2 is a cross-sectional view of another embodiment of the sound-transmitting membrane of the present invention.

As shown in FIG. 2, the resin porous membrane 11 of the sound-transmitting membrane 1 may have a multi-layer structure in which, for example, two resin porous membranes are layered. The resin porous membrane 11 has a multi-layer structure composed of a first resin porous membrane 11A and a second resin porous membrane 11B. In addition, as described above, each of the first resin porous membrane 11A and the second resin porous membrane 11B has a porous structure in which innumerable spaces formed between fine fibers (fibrils) of PTFE act as pores. The first resin porous membrane 11A or the second resin porous membrane 11B may be subjected to coloring treatment using any color or may not be subjected to coloring treatment.

It is favorable that the first resin porous membrane 11A forming one principal surface of the sound-transmitting membrane 1 should be colored black, for example. In this case, if the sound-transmitting membrane 1 is disposed to an opening of a housing of an electronic device in such a manner that the first resin porous membrane 11A faces the outside of the housing, the sound-transmitting membrane 1 is less conspicuous. The sound-transmitting membrane 1 may have a multi-layer structure in which three or more resin porous membranes are layered. In this case, it is favorable that a resin porous membrane forming one principal surface of the sound-transmitting membrane 1 should be colored based on the color (e.g., black) of the housing. In addition, the first resin porous membrane 11A or the second resin porous membrane 11B may be subjected to liquid-repellent treatment.

It is favorable that the average pore diameter of each of the first resin porous membrane 11A and the second resin porous membrane 11B should be within the range described above for the average pore diameter of the resin porous membrane 11. In addition, the average pore diameters of the first resin porous membrane 11A and the second resin porous membrane 11B may be equal to or different from each other. In addition, from the standpoint of ensuring the sound transmissibility, the surface density of the resin porous membrane 11 composed of a plurality of resin porous membranes layered on top of one another is preferably 2 to 10 g/cm$^2$, more preferably 2 to 8 g/cm$^2$, and even more preferably 2 to 5 g/cm$^2$.

The resin porous membrane 11 may have a single-layer structure as shown in FIG. 1. With this structure, the surface density of the sound-transmitting membrane 1 can be made low. Accordingly, the sound transmission loss is reduced, and thus the sound transmissibility of the sound-transmitting membrane 1 is improved.

Figure 3:
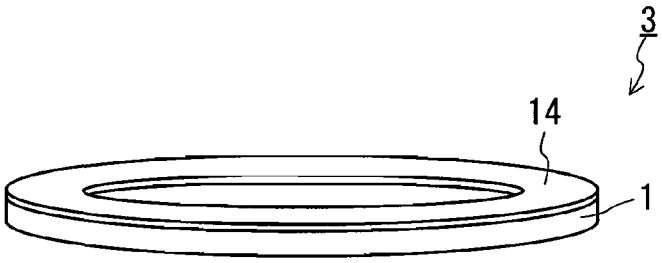
FIG. 3 is a perspective view of an example of an embodiment of a sound-transmitting member of the present invention.

As shown in FIG. 3, a sound-transmitting member 3 may be formed by attaching a ring-shaped reinforcing member 14 along an outer edge portion of the sound-transmitting membrane 1. With this structure, the sound-transmitting membrane 1 can be reinforced, and the handleability of the sound-transmitting member 3 is enhanced. In addition, since the reinforcing member 14 functions as a portion to be attached to a housing, the working efficiency in attachment of the sound-transmitting membrane 1 to the housing is improved. The shape of the reinforcing member 14 is not particularly limited as long as the sound-transmitting membrane 1 can be supported. The material of the reinforcing member 14 is not particularly limited, and a resin, a metal, or a composite material thereof can be used. The method for joining the sound-transmitting membrane 1 and the reinforcing member 14 together is not particularly limited. Examples of methods that can be employed include heat welding, ultrasonic welding, adhesion using an adhesive, and adhesion using a double-sided adhesive tape.

The sound-transmitting member 3 may be formed by attaching a ring-shaped double-sided adhesive tape along an outer edge portion of the sound-transmitting membrane 1. The sound-transmitting membrane 1 can be attached to the housing by the double-sided adhesive tape. In this case, the sound-transmitting member 3 may further include a ring-shaped reinforcing member joined to an outer edge portion of the opposite surface of the sound-transmitting membrane 1 to the surface on which the double-sided tape is attached. The material of the ring-shaped reinforcing member is not particularly limited, and a resin, a metal, or a composite material thereof can be used. The method for joining the sound-transmitting membrane 1 and the reinforcing member together is not particularly limited. Examples of methods that can be employed include heat welding, ultrasonic welding, adhesion using an adhesive, and adhesion using a double-sided adhesive tape.

An electronic device according to the present embodiment includes a sound emitter or a sound receiver. A speaker, a buzzer, and the like, can be taken as examples of the sound emitter. In addition, a microphone and the like can be taken as examples of the sound receiver. The electronic device has a housing in which an opening is formed so as to correspond to the sound emitter or the sound receiver. The above-described sound-transmitting membrane or sound-transmitting member is disposed so as to cover the opening corresponding to the sound emitter or the sound receiver, and thus the electronic device of the present embodiment is formed.

EXAMPLES

The present invention will be described in detail based on Examples. However, Examples described below are only for illustrating some examples of the present invention, and the present invention is not limited by Examples described below. First, the method for evaluating resin porous membranes or sound-transmitting membranes according to Examples and Comparative Examples will be described.

<Air Permeability>

The air permeability of each resin porous membrane or sound-transmitting membrane was evaluated in accordance with the method B (Gurley method) of air permeability measurement methods specified in JIS (Japanese Industrial Standards) L 1096.

<Water Entry Pressure>

The water entry pressure of each resin porous membrane or sound-transmitting membrane was measured using a water pressure tester (high-water pressure method) specified in JIS L 1092: 2009. However, if a test piece has an area indicated in this standard, the resin porous membrane undergoes a significant change in shape. Therefore, in order to suppress the change in shape of the resin porous membrane to a certain extent, a stainless steel mesh (opening diameter: 2 mm) was provided on a surface of the resin porous membrane opposite to a surface to which a pressure was applied, and in this state, the water entry pressure of the resin porous membrane was measured.

<Amount of Change in Shape at Water Pressure of 50 kPa>

Each sound-transmitting membrane was attached to a plate so as to cover a through hole formed in the plate and having a diameter of 2.5 mm, and then a water pressure was applied to the sound-transmitting membrane using a water pressure tester (high-water pressure method) specified in JIS L 1092: 2009. The sound-transmitting membrane was allowed to stand still for 10 minutes after the water pressure reached 50 kPa, and then the amount of change in shape of the sound-transmitting membrane before and after pressure application was obtained using a CCD laser displacement meter (LK-G87 manufactured by Keyence Corporation) for the side of the sound-transmitting membrane opposite to the surface that was subject to the water pressure.

<Liquid-Repellent Property>

A copy paper (regular paper) and each resin porous membrane were layered in such a manner that the copy paper was placed under the resin porous membrane. A lamp oil was dropped on the resin porous membrane using a dropping pipette, and then the copy paper and the resin porous membrane were left for 1 minute. Thereafter, the resin porous membrane was removed, and the condition of the copy paper was checked. In the case where the copy paper was wet, the liquid-repellent property was determined to be absent, whereas in the case where the copy paper was not wet, the liquid-repellent property was determined to be present.

<Acoustic Characteristics>

Figure 4:
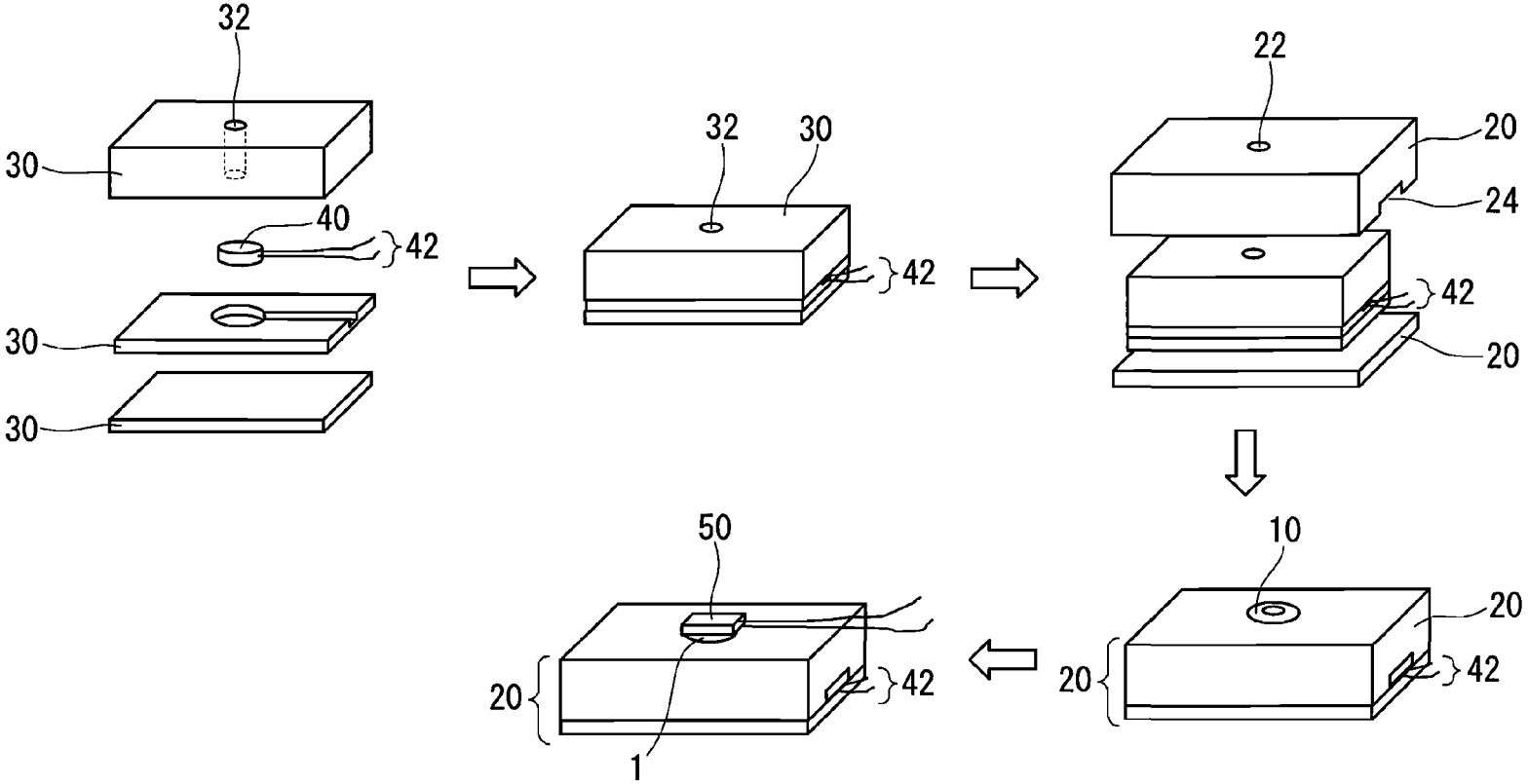
FIG. 4 is a process diagram showing the steps of measuring the acoustic characteristics of the sound-transmitting membrane.

The acoustic characteristics of the fabricated sound-transmitting membranes were evaluated as described below. First, as shown in FIG. 4, a simulated housing 20 (outer dimensions: 60 mm×50 mm×28 mm) made of polystyrene and simulating a housing of a mobile phone was prepared. The simulated housing 20 is provided with one speaker mounting hole 22 having a diameter of 2 mm and one guide hole 24 for a speaker cable 44, and any other opening was not formed. Next, as shown in FIG. 4, a speaker 40 (SCG-16A manufactured by Star Micronics Co., Ltd.) was mounted to a filling material 30 made of a urethane sponge and having a sound-transmitting hole 32 formed with a diameter of 5 mm, and then was enclosed in the simulated housing 20. The speaker cable 42 was guided to the outside of the simulated housing 20 from the guide hole 24. Thereafter, the guide hole 24 was closed with a patty.

Figure 5:
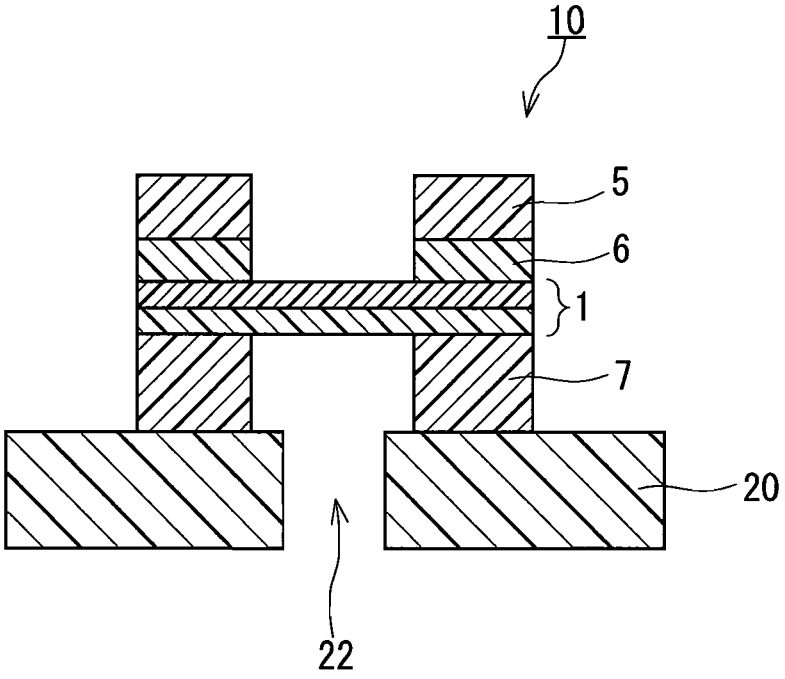
FIG. 5 is a cross-sectional view illustrating placement of the sound-transmitting membrane in measurement of the acoustic characteristics.

Next, as shown in FIG. 5, an evaluation sample 10 having an inner diameter of 2.5 mm and an outer diameter of 5.8 mm was fabricated by stamping, using the sound-transmitting membrane 1 according to each of Examples and Comparative Examples, a PET film 5 having a thickness of 0.1 mm, a double-sided adhesive tape 6 (No. 5603 manufactured by Nitto Denko Corporation, thickness: 0.03 mm) that uses PET as a supporting material, and a double-sided adhesive tape 7 (No. 57120B manufactured by Nitto Denko Corporation, thickness: 0.20 mm) that uses a polyethylene foam as a supporting material. Then, the evaluation sample 10 was attached to the outside of the speaker mounting hole 22 of the simulated housing 20. The sound-transmitting membrane 1 was attached to the simulated housing 20 in such a manner that the sound-transmitting membrane 1 covered the entire speaker mounting hole 22, and that no space was created between the double-sided adhesive tape 7 and the simulated housing 20 as well as between the sound-transmitting membrane 1 and the double-sided adhesive tape 7.

Next, a microphone 50 (Spm0405Hd4H-W8 manufactured by Knowles Acoustics) was installed over the sound-transmitting membrane 1 so as to cover the sound-transmitting membrane 1, and the microphone 50 was connected to an acoustic evaluation apparatus (Multi-analyzer System 3560-B-030 manufactured by B&K Corporation). The distance between the speaker 40 and the microphone 50 was 21 mm. Next, SSR analysis (test signal: 20 Hz to 10 kHz, sweep) was selected and executed as an evaluation method, and the acoustic characteristics (insertion loss) of the sound-transmitting membrane 1 were evaluated. When a sound pressure level was measured in a blank state where a through hole having a diameter of 2.5 mm was formed by breaking the sound-transmitting membrane 1, the blank sound pressure level was −21 dB at 1000 Hz. The insertion loss was automatically obtained from a signal received by the microphone 50 and the test signal inputted from the acoustic evaluation apparatus to the speaker 40. Specifically, the insertion loss was obtained by subtracting, from the sound pressure level in the blank state, a sound pressure level measured in the state where the sound-transmitting membrane 1 was attached, It can be determined that the smaller the insertion loss was, the better the volume of the sound outputted from the speaker 40 was maintained.

Example 1

An amount of 100 parts by weight of a PTFE fine powder (F-104 manufactured by Daikin Industries, Ltd.) and 20 parts by weight of n-dodecane (manufactured by Japan Energy Corporation) functioning as a forming auxiliary agent were uniformly mixed with each other. The obtained mixture was compressed by a cylinder, and then was formed into a sheet-shaped mixture by ram extrusion. Next, the sheet-shaped mixture obtained was passed through a pair of metal rolls, and thus rolled to a thickness of 0.16 mm. Furthermore, the mixture was dried by heating at 150° C. to remove the forming auxiliary agent. A sheet-shaped body of PTFE was thus obtained.

Next, the sheet-shaped body obtained was stretched in the longitudinal direction (the rolling direction) at a stretching temperature of 260° C. at a stretching ratio of 10, and thus a PTFE porous membrane was obtained. The PTFE porous membrane was immersed, for several seconds, in a stain solution obtained by mixing 20 parts by weight of a black dye (SP BLACK 91-L manufactured by Orient Chemical Industries Co., Ltd., a 25 weight % solution diluted with ethanol) and 80 parts by weight of ethanol (having a purity of 95%) which was a solvent of the dye. Thereafter, the membrane with the stain solution was heated to 100° C., and dried to remove the solvent. A PTFE porous membrane colored black was thus obtained.

Next, the PTFE porous membrane fabricated as described above was immersed in a liquid-repellent treatment solution for several seconds. Thereafter, the PTFE porous membrane was heated at 100° C., and dried to remove the solvent. A PTFE porous membrane having been subjected to liquid-repellent treatment was thus obtained. The liquid-repellent treatment solution was prepared as described below. An amount of 100 g of a compound having a linear fluoroalkyl chain represented by the following (Formula 1), 0.1 g of azobisisobutyronitrile functioning as a polymerization initiator, and 300 g of a solvent (FS thinner manufactured by Shin-Etsu Chemical Co., Ltd.) were put into a flask fitted with a nitrogen introducing pipe, a thermometer, and a stirrer. A nitrogen gas was introduced, accompanied by stirring, to allow addition polymerization to proceed at 70° C. for 16 hours. As a result, 80 g of a fluorine-containing polymer was obtained. This fluorine-containing polymer had a number average molecular weight of 100000. The liquid-repellent treatment solution was prepared by diluting the fluorine-containing polymer with a diluent (FS thinner manufactured by Shin-Etsu Chemical Co., Ltd.) so that the concentration of the fluorine-containing polymer was 3.0% by mass.

$$CH_2{=}CHCOOCH_2CH_2C_6F_{13} \quad \text{(Formula 1)}$$

Next, the PTFE porous membrane having been subjected to liquid-repellent treatment was stretched in the width direction at a stretching temperature of 150° C. at a stretching ratio of 10. Furthermore, the entire PTFE porous membrane was burned at 360° C. which is higher than the melting point (327° C.) of PTFE to obtain a resin porous membrane (PTFE porous membrane) according to Example 1. The obtained resin porous membrane had an average pore diameter of 0.5 μm, a surface density of 5 g/m$^2$, an air permeability of 1.0 sec/100 mL, and a water entry pressure of 80 kPa.

Next, the obtained resin porous membrane, and a nonwoven fabric (fiber diameter: 10 to 15 μm, surface density: 5 g/m$^2$) made of ethylene vinyl acetate (EVA) resin (ethylene vinyl acetate elastomer) were laminated to each other by hot press. A sound-transmitting membrane according to Example 1 was thus obtained. Here, the lamination was carried out by applying pressure for 2 seconds under the conditions of a heating temperature of 200° C. and a pressure of 0.5 MPa. In addition, the nonwoven fabric made of EVA resin was obtained by heating and melting an EVA resin at 200° C., and applying the EVA resin in a fibrous form onto a 0.075 mm-thick releasing film made of PET with a pressure of 5 kg/cm$^2$.

The sound-transmitting membrane obtained in the above manner had a surface density of 10 g/cm$^2$, an air permeability of 2.0 sec/100 mL, and a water entry pressure of 110 kPa, and exhibited such characteristics that the liquid-repellent property was "present".

Example 2

A sound-transmitting membrane according to Example 2 was obtained in the same manner as in Example 1 except that a nonwoven fabric was used that was made of EVA resin (ethylene vinyl acetate elastomer) and had a surface density of g/cm$^2$ and a fiber diameter of 10 to 15 μm.

Example 3

A sound-transmitting membrane according to Example 3 was obtained in the same manner as in Example 1 except that a nonwoven fabric was used that was made of EVA resin (ethylene vinyl acetate elastomer) and had a surface density of g/cm$^2$ and a fiber diameter of 10 to 15 μm.

Example 4

A sound-transmitting membrane according to Example 4 was obtained in the same manner as in Example 1 except that a nonwoven fabric (Espansione FF manufactured by KB Seiren. Ltd.) was used that was made of polyurethane resin (polyurethane elastomer) and had a surface density of 25 g/cm$^2$ and a fiber diameter of 25 to 30 μm.

Example 5

A sound-transmitting membrane according to Example 5 was obtained in the same manner as in Example 1 except that a nonwoven fabric (STRAFLEX P PN5065R manufactured by Idemitsu Unitech Co., Ltd.) was used that was made of polyamide-based elastomer resin and had a surface density of 40 g/cm$^2$ and a fiber diameter of 18 to 25 μm.

Comparative Example 1

A sound-transmitting membrane according to Comparative Example 1 was obtained in the same manner as in Example 1 except that a nonwoven fabric (HOP6 manufactured by Hirose Paper Mfg Co., Ltd.) was used that was composed of core-clad fibers of polypropylene (PP) and polyethylene (PE), and had a surface density of 6 g/cm$^2$ and a fiber diameter of 20 to 22 μm.

Comparative Example 2

A sound-transmitting membrane according to Comparative Example 2 was obtained in the same manner as in Example 1 except that a nonwoven fabric (Eleves T0303WDO manufactured by Unitika Ltd.) was used that was composed of core-clad fibers of polyethylene terephthalate (PET) and polyethylene (PE), and had a surface density of 30 g/cm$^2$ and a fiber diameter of 20 to 25 μm.

In Examples 2 to 5 and Comparative Examples 1 and 2, the lamination was performed at a temperature adjusted to be appropriate for the material of each nonwoven fabric, and the heating time and the applied pressure were the same as in Example 1.

Comparative Example 3

A two-part heat-curing silicone resin (manufactured by Dow Corning Toray Co., Ltd.) diluted with toluene was cast onto a silicone release separator (MRS50 manufactured by Mitsubishi Plastics, Inc.), and then a thin film was formed using an applicator. The thin film of silicone resin and a resin porous membrane fabricated in the same manner as in Example 1 were layered, and then were heated and dried to obtain a layered product of the silicone resin sheet and the resin porous membrane (PTFE porous membrane). In this manner, a sound-transmitting membrane according to Comparative Example 3 was obtained.

Figure 6:
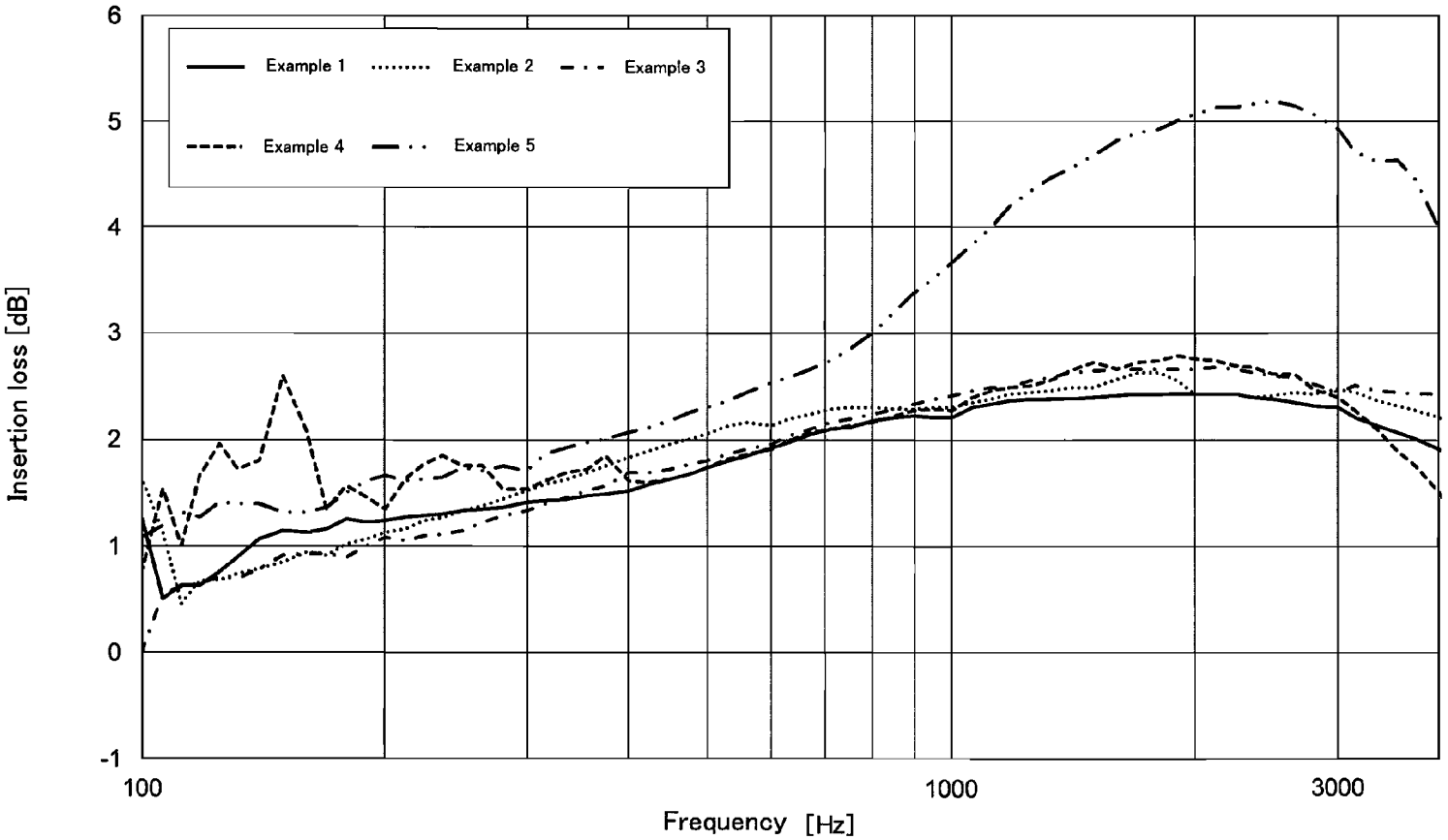
FIG. 6 is a graph showing the acoustic characteristics of sound-transmitting membranes according to Examples.
Figure 7:
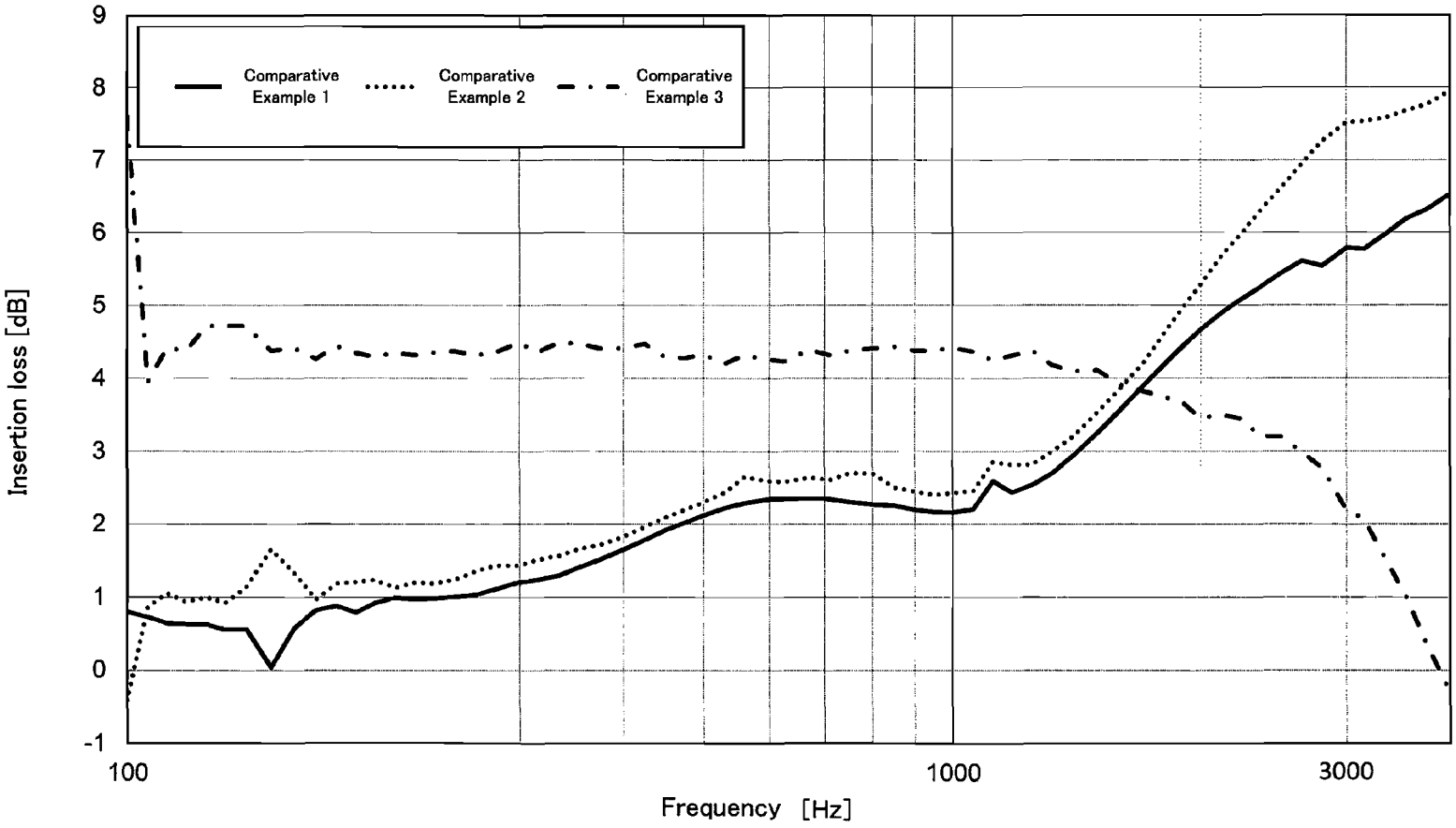
FIG. 7 is a graph showing the acoustic characteristics of sound-transmitting membranes according to Comparative Examples.

Table 1 shows the characteristics of the sound-transmitting membranes according to Examples and Comparative Examples. In addition, FIG. 6 shows a graph showing the relationships between the sound frequency and the insertion loss in Examples 1 to 5, and FIG. 7 shows a graph showing the relationships between the sound frequency and the insertion loss in Comparative Examples 1 to 3.

As shown in Table 1, in all of the sound-transmitting membranes according to Examples 1 to 5, the insertion loss for sounds of 3000 Hz was 5 dB or less. In addition, the ratio of the insertion loss for sounds of 3000 Hz to the insertion loss for sounds of 1000 Hz in the sound-transmitting membranes according to Examples 1 to 5 was 1.00 to 1.32. In other words, the sound-transmitting membranes according to Examples 1 to 5 exhibited similar levels of insertion loss for both sounds of 1000 Hz and sounds of 3000 Hz. Furthermore, in the sound-transmitting membranes according to Examples 1 to 5, the difference between a maximum value and a minimum value of the insertion losses for sounds of 100 Hz to 4000 Hz was 1.92 to 4.11 dB. This indicated that the sound-transmitting membranes according to Examples 1 to 5 exhibited such acoustic characteristics that the insertion loss does not vary much for sounds in a frequency range of 100 Hz to 4000 Hz.

TABLE 1

| | Surface Density [g/m$^2$] | Air permeability [sec/100 mL] | Water entry pressure [kPa] | Amount of Change in shape at water pressure of 50 kPa [mm] | Insertion loss [dB] 1000 Hz | Insertion loss [dB] 3000 Hz | Insertion loss ratio |
|---|---|---|---|---|---|---|---|
| Example 1 | 10 | 2.0 | 110 | 0.52 | 2.2 | 2.3 | 1.05 |
| Example 2 | 15 | 2.2 | 110 | 0.46 | 2.3 | 2.5 | 1.09 |
| Example 3 | 20 | 2.3 | 120 | 0.42 | 2.4 | 2.4 | 1.00 |
| Example 4 | 30 | 2.0 | 120 | 0.40 | 2.3 | 2.4 | 1.04 |
| Example 5 | 45 | 2.0 | 120 | 0.40 | 3.7 | 4.9 | 1.32 |
| Com. Example 1 | 11 | 0.7 | 140 | 0.32 | 2.2 | 5.8 | 2.64 |
| Com. Example 2 | 35 | 1.1 | 140 | 0.27 | 2.4 | 7.5 | 3.13 |
| Com. Example 3 | 55 | No air permeability | 200 | 0.63 | 4.4 | 2.2 | 0.50 |

The invention may be embodied in other forms without departing from the spirit or essential characteristics thereof. The embodiments disclosed in this specification are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A sound-transmitting membrane that allows passage of sounds and prevents passage of foreign matters, the sound-transmitting membrane comprising:

a supporting member; and a resin porous membrane layered on the supporting member and containing polytetrafluoroethylene as a main component, wherein the supporting member is a nonwoven fabric comprising an elastomer, an insertion loss for sounds of 3000 Hz of the sound-transmitting membrane is smaller than or equal to 5 dB, and a ratio of the insertion loss for the sounds of 3000 Hz to an insertion loss for sounds of 1000 Hz of the sound-transmitting membrane is in a range from 1.0 to 2.0.

2. The sound-transmitting membrane according to claim 1, wherein a difference between a maximum value and a minimum value of insertion losses for sounds in a range from 100 Hz to 4000 Hz is smaller than or equal to 5 dB.

3. The sound-transmitting membrane according to claim 1, having a surface density in a range from 5 to 50 $g/m^2$.

4. An electronic device comprising:

a sound emitter or a sound receiver; and the sound-transmitting membrane according to claim 1 that is disposed so as to cover an opening corresponding to the sound emitter or the sound receiver.

* * * * *